US011172708B2

(12) United States Patent
Gill et al.

(10) Patent No.: US 11,172,708 B2
(45) Date of Patent: Nov. 16, 2021

(54) AEROSOL GENERATING SYSTEMS

(71) Applicant: JT International SA, Geneva (CH)

(72) Inventors: Mark Gill, Watford (GB); Lubos Brvenik, London (GB)

(73) Assignee: JT International SA

( * ) Notice: Subject to any disclaimer, the term of this patent is extended or adjusted under 35 U.S.C. 154(b) by 292 days.

(21) Appl. No.: 16/097,531

(22) PCT Filed: May 3, 2017

(86) PCT No.: PCT/EP2017/060507
§ 371 (c)(1),
(2) Date: Oct. 29, 2018

(87) PCT Pub. No.: WO2017/191176
PCT Pub. Date: Nov. 9, 2017

(65) Prior Publication Data

US 2019/0142066 A1 May 16, 2019

(30) Foreign Application Priority Data

May 5, 2016 (GB) ..... 1607839

(51) Int. Cl.
*A24F 47/00* (2020.01)
*A24F 40/51* (2020.01)
(Continued)

(52) U.S. Cl.
CPC ..... *A24F 40/51* (2020.01); *A24B 15/167* (2016.11); *A24F 7/00* (2013.01); *A24F 40/30* (2020.01); *A24F 40/44* (2020.01); *A24F 40/465* (2020.01); *A24F 40/57* (2020.01); *H05B 6/108* (2013.01); *A24F 40/10* (2020.01); *A24F 40/20* (2020.01)

(58) Field of Classification Search
CPC ..... A24F 40/30; A24F 40/465; A24F 47/008
See application file for complete search history.

(56) References Cited

U.S. PATENT DOCUMENTS

2012/0184905 A1* 7/2012 Shekalim ..... A61M 5/14276 604/132
2014/0366898 A1* 12/2014 Monsees ..... A24F 47/008 131/329

(Continued)

FOREIGN PATENT DOCUMENTS

GB 2504732 A 2/2014
GB 2527597 A 12/2015

(Continued)

OTHER PUBLICATIONS

International Search Report and Written Opinion for PCT/EP2017/060507, dated Sep. 10, 2017.

*Primary Examiner* — Eric Yaary
(74) *Attorney, Agent, or Firm* — Lerner, David, Littenberg, Krumholz & Mentlik, LLP

(57) ABSTRACT

A cartridge (30) for use with an aerosol generating system (10) includes a reservoir (32) for storing an aerosol-forming liquid (34) and an induction heatable element (36). The cartridge (30) employs a capillary element (38) to convey the aerosol-forming liquid (34) from the reservoir (32) to the induction heatable element (36) and the induction heatable element (36) is arranged to heat the conveyed aerosol-forming liquid to vaporise it.

26 Claims, 4 Drawing Sheets

(51) Int. Cl.

| | |
|---|---|
| ***A24F 40/465*** | (2020.01) |
| ***A24F 40/30*** | (2020.01) |
| ***A24F 40/44*** | (2020.01) |
| ***A24F 40/57*** | (2020.01) |
| ***A24B 15/167*** | (2020.01) |
| ***A24F 7/00*** | (2006.01) |
| ***H05B 6/10*** | (2006.01) |
| *A24F 40/10* | (2020.01) |
| *A24F 40/20* | (2020.01) |

(56) References Cited

U.S. PATENT DOCUMENTS

| | | | | |
|---|---|---|---|---|
| 2015/0128967 | A1 | 5/2015 | Robinson et al. | |
| 2015/0245669 | A1 | 9/2015 | Cadieux et al. | |
| 2015/0272216 | A1* | 10/2015 | Dai | A24F 47/008 131/328 |
| 2015/0320116 | A1 | 11/2015 | Bleloch et al. | |
| 2017/0202266 | A1* | 7/2017 | Sur | H05B 6/108 |
| 2018/0192700 | A1* | 7/2018 | Fraser | A24F 47/008 |
| 2019/0124981 | A1* | 5/2019 | Fursa | A24F 47/008 |

FOREIGN PATENT DOCUMENTS

| | | | |
|---|---|---|---|
| WO | 2015177043 | A1 | 11/2015 |
| WO | 2016014652 | A1 | 1/2016 |

* cited by examiner

AEROSOL GENERATING SYSTEMS

CROSS-REFERENCE TO RELATED APPLICATIONS

The present application is a national phase entry under 35 U.S.C. § 371 of International Application No. PCT/EP2017/060507, filed May 3, 2017, published in English, which claims priority to Great Britain Application No. 1607839.6, filed May 5, 2016, the disclosures of which are incorporated herein by reference.

TECHNICAL FIELD

The present disclosure relates generally to aerosol generating systems and more particularly to a cartridge for use with an aerosol generating system, the cartridge containing an aerosol-forming liquid which can be heated to produce an aerosol for inhalation by a user.

TECHNICAL BACKGROUND

The use of aerosol generating systems (also known as electronic cigarettes, e-cigarettes, personal vaporisers and electronic vapour inhalers), which can be used as an alternative to conventional smoking articles such as lit-end cigarettes, cigars, and pipes, is becoming increasingly popular and widespread. The most commonly used e-cigarettes are usually battery powered and use a resistance heating element to heat and atomise a liquid containing nicotine, to produce a nicotine-containing aerosol (often called vapour) which can be inhaled by a user. The aerosol is inhaled through a mouthpiece to deliver nicotine to the lungs, and aerosol exhaled by the user generally mimics the appearance of smoke from a conventional smoking article. Although inhalation of the aerosol creates a physical sensation which is similar to conventional smoking, harmful chemicals such as carbon dioxide and tar are not produced or inhaled because there is no combustion.

In the conventional e-cigarettes described above, the liquid is wicked onto the resistance heating element where it is heated and vaporised. However, problems can arise with continued use of the e-cigarette, because deposits form on the surface of the resistance heating element due to localised burning of the liquid. This can reduce the efficiency of the resistance heating element. Furthermore, when the deposits are subsequently heated during operation of the e-cigarette, they can evaporate to create an unpleasant taste and/or generate harmful gases. These problems can be addressed by replacing the resistance heating element or the e-cigarette itself, but this involves unwanted expense and inconvenience for the user.

The present disclosure seeks to address these difficulties.

SUMMARY OF THE DISCLOSURE

According to a first aspect of the present disclosure, there is provided a cartridge for use with an aerosol generating system, the cartridge comprising:

- a reservoir for storing an aerosol-forming liquid;
- an induction heatable element; and
- a capillary element for conveying the aerosol-forming liquid from the reservoir to the induction heatable element, the induction heatable element being arranged to heat the conveyed aerosol-forming liquid to vaporise it.

The cartridge provides a convenient way for a user to load the aerosol-forming liquid into the electronic vapour inhaler, reducing the likelihood of spillage and waste. The reservoir may be non-refillable or may be refillable.

The conveyed aerosol-forming liquid is heated rapidly and efficiently by the induction heatable element in the presence of an electromagnetic field and this gives a fast heating response. The aerosol-forming liquid conveyed by the capillary element from the reservoir to the induction heatable element is vaporised when the induction heatable element heats the aerosol-forming liquid to its boiling point and this causes the capillary element to convey more aerosol-forming liquid from the reservoir to the induction heatable element by virtue of capillary action.

The cartridge does not have any moving parts and the induction heatable element does not require an electrical connection. In preferred embodiments the induction heatable element can be discarded with the cartridge. Optimal heating is achieved during the whole process of vaporising the contents of the reservoir due to precise microprocessor controlled energy delivery. Since the induction heatable element is renewed each time the cartridge is replaced, there is no reduction in performance or degradation in flavour or aroma over time. This is to be contrasted, for example, with the conventional aerosol-generating systems described above which employ a resistance heating element. In other embodiments, the induction heatable element can be easily replaced by a user thereby offering the advantages described above. Because the induction heatable element is a low-cost component, it can be replaced at minimal expense unlike the resistance heating element in the conventional e-cigarettes described above.

The capillary element is formed from an electrically insulating material. Thus, the capillary element does not heat up in the presence of an electromagnetic field. The capillary element is desirably formed from a heat-resistant material so that it can withstand the high temperatures attained by the induction heatable element during operation of the aerosol generating system.

The capillary element may contact the induction heatable element.

The capillary element may be located adjacent to, but spaced apart from, the induction heatable element. The spacing between the capillary element and the induction heatable element can be varied. The spacing controls the amount of aerosol-forming liquid which is stored on the induction heatable element and which is available for vaporisation when the induction heatable element is heated. Thus, the spacing affects, and can be optimised to control, the amount of aerosol generated when a user inhales during operation of the aerosol generating system.

The capillary element may have a first end in contact with the aerosol-forming liquid in the reservoir and an opposite second end arranged to transfer the conveyed aerosol-forming liquid onto the induction heatable element.

The second end of the capillary element may contact the induction heatable element. In this case, the second end of the capillary element may be shaped, e.g., may include a cut-out portion, to define an outlet which enables the conveyed liquid to be transferred from the second end onto the induction heatable element. The shaping, e.g., the depth of the cut-out portion, controls the amount of aerosol-forming liquid which is stored on the induction heatable element and which is available for vaporisation when the induction heatable element is heated. Thus, the shaping affects, and can be optimised to control, the amount of aerosol generated when a user inhales during operation of the aerosol generating system.

The second end of the capillary element may be located adjacent to, but spaced apart from, the induction heatable element. The spacing between the second end of the capillary element and the induction heatable element can be varied and the spacing controls the amount of aerosol-forming liquid which is stored on the induction heatable element and which is available for vaporisation when the induction heatable element is heated. Thus, the spacing affects, and can be optimised to control, the amount of aerosol generated when a user inhales during operation of the aerosol generating system.

The capillary element may comprise a capillary tube and/or a capillary wick. The capillary wick may comprise a plurality of wicking strands.

The cartridge may include a plurality of said capillary elements for conveying the aerosol-forming liquid from the reservoir to the induction heatable element. The use of a plurality of capillary elements provides an increased rate of transfer of the aerosol-forming liquid to the induction heatable element.

The capillary element may comprise a porous body. The porous body may include mineral wool.

The porous body may be a porous body of solid material. The porous body may include a porous ceramic material.

The induction heatable element may be encapsulated by the porous body. This may provide for enhanced heating of the aerosol-forming liquid.

The induction heatable element may comprise a substantially circular disc. The disc may have a thickness in the range from 20 μm to 1.5 mm. The disc may have a diameter in the range from 6 mm to 12 mm.

The induction heatable element may comprise aluminium or any conductive material which heats up in the presence of an electromagnetic field as a result of eddy currents induced in the induction heatable element and/or hysteresis losses.

The cartridge may comprise:

- a first reservoir for storing a first aerosol-forming liquid;
- a first induction heatable element;
- a first capillary element for conveying the first aerosol-forming liquid from the first reservoir to the first induction heatable element, the first induction heatable element being arranged to heat the conveyed first aerosol-forming liquid to vaporise it;
- a second reservoir for storing a second aerosol-forming liquid which differs in composition from the first aerosol-forming liquid;
- a second induction heatable element; and
- a second capillary element for conveying the second aerosol-forming liquid from the second reservoir to the second induction heatable element, the second induction heatable element being arranged to heat the conveyed second aerosol-forming liquid to vaporise it.

The first and second induction heatable elements may be arranged to be heated to different temperatures by the aerosol generating system. The cartridge can, therefore, be used to heat aerosol-forming liquids having different boiling points, thus providing optimal heating of the individual liquids and ensuring that neither liquid is overheated. For example, the first aerosol-forming liquid may be vegetable glycerin and the first induction heatable element may be arranged to heat the vegetable glycerin to a temperature of approximately 290° C. to vaporise it. The second liquid may be propylene glycol and the second induction heatable element may be arranged to heat the propylene glycol to a temperature of approximately 189° C. to vaporise it.

The first and second induction heatable elements may be formed of different materials and/or may have different dimensions. This enables the first and second induction heatable elements to be heated to different temperatures when subjected to the same electromagnetic field during operation of the aerosol-generating system.

The above arrangements employing first and second reservoirs in combination with corresponding first and second induction heatable elements are advantageous since they enable an aerosol to be generated using two different aerosol-forming liquids with different boiling points in a single, easy-to-use, cartridge. The use of two aerosol-forming liquids is advantageous since it may allow the flavour and aroma of the resultant aerosol to be optimised.

It should be understood that further reservoirs, induction heatable elements and capillary elements may be provided so that more than two different aerosol-forming liquids can be heated to different temperatures to vaporise them and thereby produce an aerosol for inhalation by a user.

The cartridge may comprise a non-liquid flavour-release medium and may comprise a further induction heatable element arranged to heat the non-liquid flavour-release medium. Heat is transferred from the further induction heatable element to the non-liquid flavour-release medium by one or more of conduction, radiation and convection.

The non-liquid flavour-release medium may comprise any material or combination of materials which can be heated to release a vapour or aerosol for inhalation by a user. The non-liquid flavour-release medium is a dry material and can be easily handled. The non-liquid flavour-release medium may be tobacco or a tobacco material or a dry herbal material. The non-liquid flavour-release medium could take any suitable form, including fine pieces or pellets or a fibrous form. The non-liquid flavour-release medium may be impregnated with a vapour-forming medium such as propylene glycol, glycerol or a combination thereof.

Such a 'hybrid' arrangement, using an aerosol-forming liquid and a non-liquid flavour-release medium is highly advantageous since it allows the principal part of the aerosol to be formed by vaporisation of the aerosol-forming liquid whilst at the same time allowing more complex flavour compounds to be released by heating the non-liquid flavour-release medium. The resulting aerosol inhaled by the user has a flavour and aroma which mimics as closely as possible the flavour and aroma of a conventional lit-end cigarette or other conventional smoking article.

The non-liquid flavour-release medium may be adhered to a surface of the further induction heatable element. The non-liquid flavour-release medium may alternatively be packed around the further induction heatable element.

The cartridge may include one or more further capillary elements for conveying the aerosol-forming liquid from the reservoir to the non-liquid flavour-release medium. This arrangement advantageously ensures that the aerosol-forming liquid can permeate onto the non-liquid flavour-release medium at an optimum rate to prevent it from drying out and possibly burning and/or charring during the heating process.

The or each further capillary element may comprise a capillary tube and/or a capillary wick. The or each further capillary element may include one or more of the features of the capillary element defined above.

The cartridge may comprise a housing in which the liquid reservoir may be located. The housing may have one or more air inlets through which ambient air can flow into the housing and a mouthpiece defining an outlet through which an aerosol can be inhaled by a user.

According to a second aspect of the present disclosure, there is provided an aerosol generating system comprising:

a cartridge according to the first aspect of the present disclosure and an induction heating arrangement arranged to inductively heat the induction heatable element(s).

The induction heating arrangement typically comprises an induction coil.

The aerosol generating system may comprise a body in which the induction heating arrangement is accommodated and a cavity may be formed in the body in which the cartridge may be removably inserted.

The aerosol generating system may further include a capsule comprising:

a shell containing a non-liquid flavour-release medium;

an induction heatable element disposed inside the shell and arranged to heat the non-liquid flavour-release medium;

at least part of the shell comprising an air permeable material.

The capsule may be as described in GB 2527597 A.

Again, this is a 'hybrid' arrangement, using an aerosol-forming liquid and a non-liquid flavour-release medium, and has the same advantages as the 'hybrid' arrangement described above.

The aerosol generating system may include a subsidiary induction heatable element, at least part of which is exposed to enable the temperature of the subsidiary induction heatable element to be directly measured, for example using a probe. A predetermined relationship between the temperature of the subsidiary induction heatable element and the temperatures of the induction heatable elements which heat the aerosol-forming liquid(s) and optionally the non-liquid flavour-release medium allows the temperature(s) of the induction heatable elements to be determined indirectly, by measuring the temperature of the subsidiary induction heatable element. This is advantageous because direct measurement of the temperatures of the induction heatable elements which heat the conveyed aerosol-forming liquid(s) and optionally the non-liquid flavour-release medium is generally impractical due to their size and/or inaccessibility.

According to a third aspect of the present disclosure, there is provided an aerosol generating system comprising:

an induction heating arrangement arranged to inductively heat at least one induction heatable element and thereby heat one or more of an aerosol-forming liquid and a non-liquid flavour-release medium; and a subsidiary induction heatable element arranged to be heated by the induction heating arrangement;

wherein at least part of the subsidiary induction heatable element is exposed to enable the temperature of the subsidiary induction heatable element to be directly measured, and wherein a predetermined relationship between the temperature of the subsidiary induction heatable element and the temperature of the at least one induction heatable element enables the temperature of the at least one induction heatable element to be determined indirectly.

According to a fourth aspect of the present disclosure, there is provided a method for determining the temperature of at least one induction heatable element in an aerosol generating system comprising an induction heating arrangement arranged to inductively heat the at least one induction heatable element and thereby heat one or more of an aerosol-forming liquid and a non-liquid flavour-release medium, and a subsidiary induction heatable element arranged to be heated by the induction heating arrangement, at least part of the subsidiary induction heatable element being exposed, the method comprising:

directly measuring the temperature of the exposed part of the subsidiary induction heatable element and determining the temperature of the at least one induction heatable element based on a predetermined relationship between the temperature of the subsidiary induction heatable element and the temperature of the at least one induction heatable element.

The subsidiary induction heatable element preferably has smaller dimensions than the or each induction heatable element which heats the aerosol-forming liquid(s) and/or the non-liquid flavour-release medium.

DETAILED DESCRIPTION OF EMBODIMENTS

Embodiments of the present disclosure will now be described by way of example only and with reference to the accompanying drawings.

Figure 1:
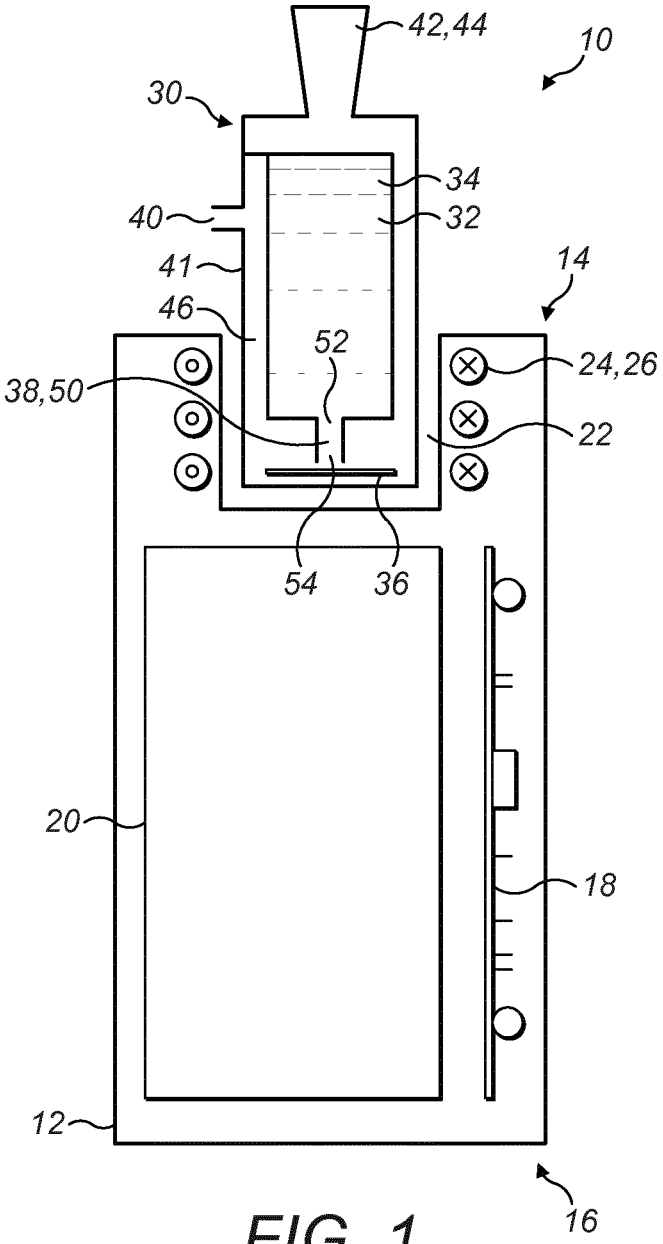
FIG. 1 is a diagrammatic cross-sectional view of an aerosol generating system according to the present disclosure.

Referring initially to FIG. 1, an aerosol generating system 10 comprises a generally cylindrical elongate body 12 having a proximal end 14 and a distal end 16. The aerosol generating system 10 includes a control arrangement 18, e.g., in the form of a printed circuit board, and a power source 20 in the form of one or more batteries which could, for example, be inductively rechargeable. The body 12 includes a cavity 22 at the proximal end 14 into which a cartridge 30 can be removably inserted.

Figure 2A:
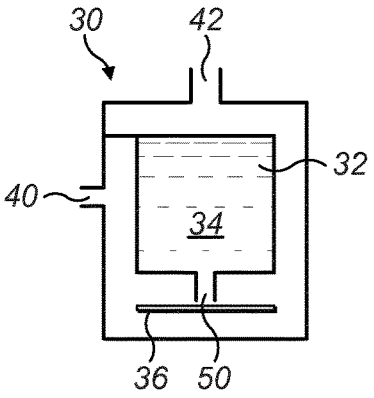
FIGS. 2*a-h* are diagrammatic cross-sectional views of various embodiments of a cartridge for use with the aerosol generating system of FIG. 1.

The cartridge 30, shown as a separate component in FIG. 2*a*, has a generally cylindrical shape and comprises a reservoir 32 for storing an aerosol-forming liquid 34, such as propylene glycol, vegetable glycerin or a combination thereof, and an induction heatable element 36 in the form of an induction heatable disc. The induction heatable element 36 is formed of a conductive material which heats up in the presence of an electromagnetic field as a result of eddy currents induced in the induction heatable element 36 and/or hysteresis losses. The cartridge 30 comprises a capillary element 38 for conveying the aerosol-forming liquid 34 from the reservoir 32 to the induction heatable element 36. The capillary element 38 is formed from an electrically insulating and non-magnetic material and thus it does not heat up in the presence of an electromagnetic field. The cartridge 30 also comprises a housing 41 in which the liquid reservoir is formed. The housing 41 has an air inlet 40 and an outlet 42 defining a mouthpiece 44 through which an aerosol can be inhaled by a user.

The aerosol generating system 10 includes an induction heating arrangement 24 comprising an induction coil 26 which can be energised by the power source 20 and the operation of which can be controlled by the control arrangement 18. As will be understood by those skilled in the art, when the induction coil 26 is energised, an alternating and time-varying electromagnetic field is produced which generates eddy currents and/or hysteresis losses in the induction heatable element 36 causing it to heat up. As a result, the aerosol-forming liquid 34 conveyed to the induction heatable element 36 by the capillary element 38 is heated and the aerosol-forming liquid 34 vaporises when it reaches its boiling point. When a user inhales through the mouthpiece 44, air is drawn into the air inlet 40 and flows along a passageway 46 defined in the housing 41. The vaporised aerosol-forming liquid is entrained in the air flowing through the passageway 46 and cools to form an aerosol before exiting the mouthpiece 44 and entering the user's mouth. As liquid 34 conveyed from the reservoir 32 to the induction heatable element 36 is vaporised during operation of the aerosol generating system 10, it will be understood that further aerosol-forming liquid 34 is conveyed by the capillary element 38 from the reservoir 32 to the induction heatable element 36 by virtue of capillary action.

Figure 2B:
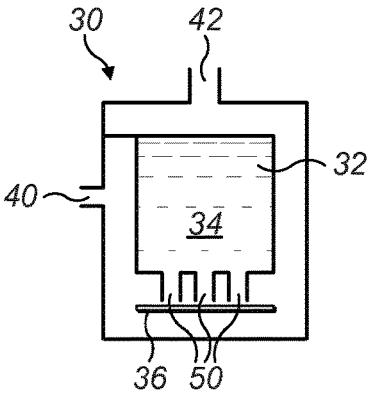

In the cartridge 30 illustrated in FIGS. 1 and 2*a*, the capillary element 38 comprises a capillary tube 50 having a first end 52 in contact with the aerosol-forming liquid 34 in the reservoir 32 and an opposite second end 54 which is arranged to transfer the conveyed liquid 34 onto the induction heatable element 36. In some embodiments, as shown in FIG. 2*b*, a plurality of the capillary tubes 50 are provided to convey the aerosol-forming liquid 34.

Figure 2C:
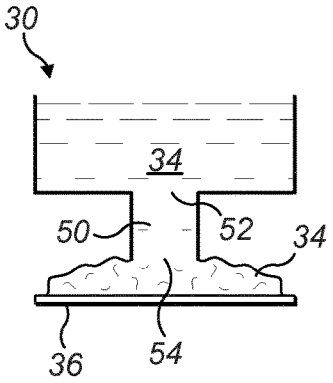

In the embodiment shown in FIG. 2*c*, the second end 54 of the capillary tube 50 is spaced from the surface of the induction heatable element 36. The spacing determines the amount of the aerosol-forming liquid 34 that is stored on the surface of the induction heatable element 36 and the spacing can be varied. In general terms, as the spacing between the second end 54 of the capillary tube 50 and the surface of the induction heatable element 36 increases, the amount of the aerosol-forming liquid 34 stored on the induction heatable element 36 also increases. As the amount of stored aerosol-forming liquid 34 increases, so too does the amount of aerosol generated when a user inhales through the mouthpiece 44 during operation of the aerosol generating system 10.

Figure 2D:
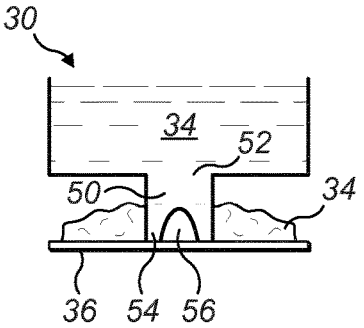

In the embodiment shown in FIG. 2*d*, the second end 54 of the capillary tube 50 is arranged to be in contact with the surface of the induction heatable element 36 and is shaped or configured to allow the transfer of conveyed liquid 34 from the second end 54 onto the induction heatable element 36 so that it can be vaporised. More particularly, it will be seen in FIG. 2*d* that the second end 54 includes a cut-out portion 56 which defines an outlet to allow the conveyed liquid 34 to be transferred onto the surface of the induction heatable element 36. It will be noted from FIG. 2*d* that the depth of the cut-out portion 56 controls the amount of liquid 34 stored on the surface of the induction heatable element 36, and in particular that the surface level of the stored liquid 34 corresponds to the depth of the cut-out portion 56.

Figure 2E:
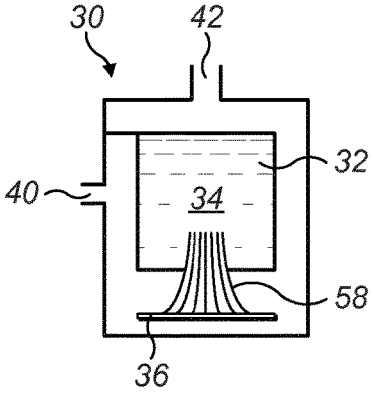

In the embodiment shown in FIG. 2*e*, the capillary element 38 comprises a capillary wick 58 which comprises a plurality of strands of a suitable wicking material.

Figure 2F:
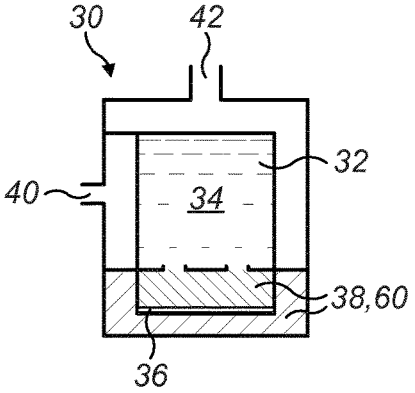

In the embodiment shown in FIG. 2*f*, the capillary element 38 comprises a porous body 60, for example mineral wool. In this embodiment, it will be seen that the induction heatable element 36 is encapsulated by the porous body 60 so that both the upper and lower surfaces of the induction heatable element 36 are in contact with the porous body 60 and, hence, the conveyed aerosol-forming liquid 34.

Figure 2G:
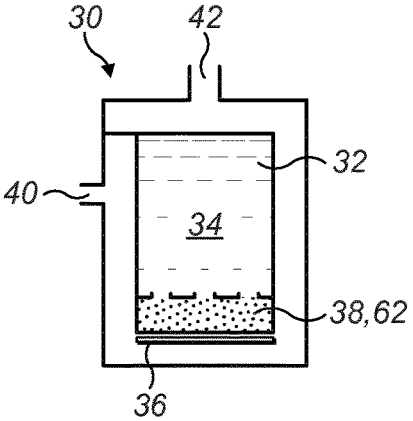
Figure 2H:
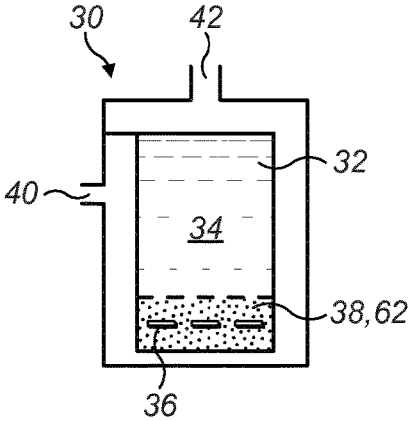

In the embodiment of FIGS. 2*g* and 2*h*, the capillary element 38 comprises a porous body 62 of ceramic material or another suitable solid material. In the cartridge 30 of FIG. 2*g*, an upper surface of the induction heatable element 36 is in direct contact with the porous body 62 and, hence, the conveyed aerosol-forming liquid 34. In the cartridge of FIG. 2*h*, the induction heatable element 36 is encapsulated by the porous body 62 so that both the upper and lower surfaces of the induction heatable element 36 are in contact with the porous body 60 and, hence, the conveyed aerosol-forming liquid 34. In order to facilitate the flow of liquid and vapour through porous body 62, the induction heatable element 36 may include one or more apertures or perforations as seen in FIG. 2*h* (e.g. it may be in the form of a perforated disc).

Figure 3:
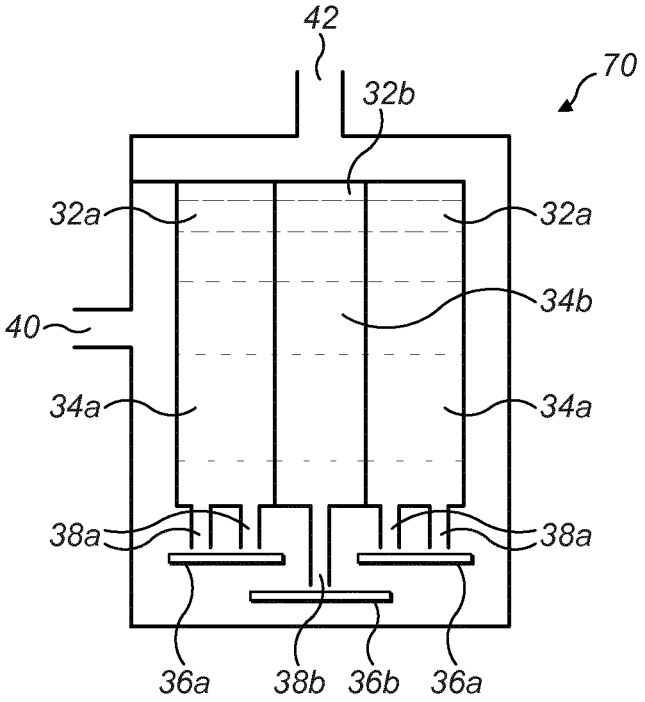
FIG. 3 is a diagrammatic cross-sectional view of a cartridge having a plurality of liquid reservoirs.

Referring now to FIG. 3, there is shown a cartridge 70 which comprises a ring-shaped first reservoir 32*a* and a cylindrical second reservoir 32*b* for storing respectively first and second aerosol-forming liquids 34*a*, 34*b*. The cartridge 70 includes first and second induction heatable elements 36*a*, 36*b* associated with each of the first and second reservoirs 32*a*, 32*b*, and a plurality of first capillary elements 38*a* and a second capillary element 38*b* for conveying respectively the first and second aerosol-forming liquids 34*a*, 34*b* from the first and second reservoirs 32*a*, 32*b* to the corresponding first and second induction heatable elements 36*a*, 36*b* so that the conveyed first and second aerosol-forming liquids can be vaporised by the first and second induction heatable elements 36*a*, 36*b*.

The first and second aerosol-forming liquids 34*a*, 34*b* stored in the first and second reservoirs 32*a*, 32*b* differ from each other and have different boiling points. In one embodiment, the first aerosol-forming liquid 34*a* is vegetable glycerin and has a boiling point of approximately 290° C. whilst the second aerosol-forming liquid 34*b* is propylene glycol and has a lower boiling point of approximately 189° C.

Although FIG. 3 is a diagrammatic illustration, it will be readily appreciated that the first and second induction heatable elements 36*a*, 36*b* have different dimensions and in particular that the first induction heatable element 36*a*, which is generally ring-shaped, has a larger outer diameter than the second induction heatable element 36*b* which is in the form of a disc and that the first induction heatable element 36*a* is positioned closer to the induction coil 26 when the cartridge 70 is inserted into the cavity 22 in the body 12 of the aerosol generating system 10 shown in FIG. 1. As a consequence, the electromagnetic coupling between the first induction heatable element 36*a* and the induction coil 26 is greater than the electromagnetic coupling between the second induction heatable element 36*b* and the induction coil 26. The result of this is that the first induction heatable element 36*a* is heated by the same electromagnetic field to a higher temperature than the second induction heatable element 36*b*. By suitably configuring and arranging the first and second induction heatable elements 36*a*, 36*b*, it will thus be understood that they can be heated to different temperatures which are optimised for heating and vaporising the different first and second aerosol-forming liquids 34*a*, 34*b*. Although vegetable glycerin and propylene glycol have been given as examples of the first and second aerosol-forming liquids 34*a*, 34*b*, it will be readily understood by the person skilled in the art that other aerosol-forming liquids can be used.

Figure 4A:
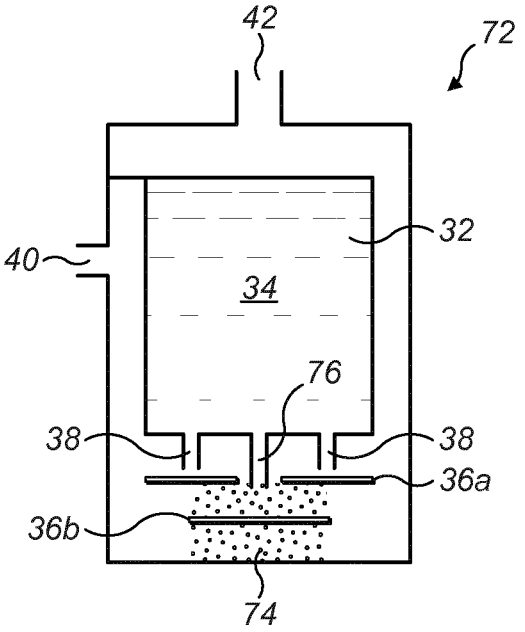
FIGS. 4*a* and 4*b* are diagrammatic cross-sectional views of a cartridge containing an aerosol-forming liquid and a non-liquid flavour-release medium.
Figure 4B:
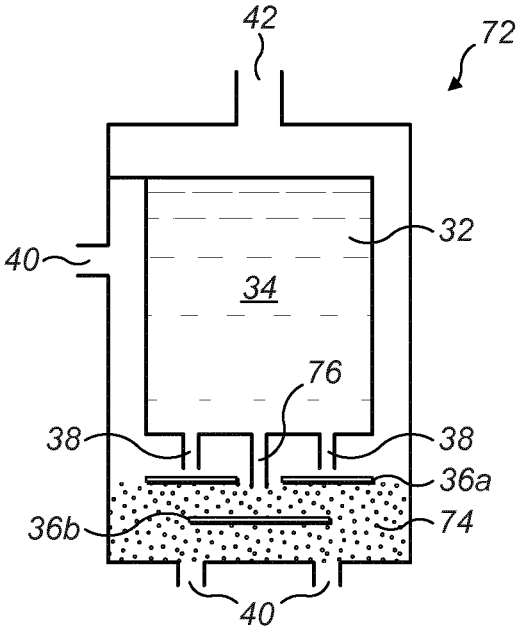

FIGS. 4*a* and 4*b* illustrate 'hybrid' cartridges 72 which use a non-liquid flavour-release medium 74 in combination with an aerosol-forming liquid 34, for example of the type already described. The non-liquid flavour-release medium 74 typically comprises tobacco material, but other non-liquid flavour-release media can be used as described earlier in this specification. The non-liquid flavour-release medium 74 is typically impregnated with a vapour-forming medium, such as propylene glycol, glycerol or a combination of both, and when heated to a temperature within an operating temperature range produces a vapour for inhalation by a user.

The cartridges 72 illustrated in FIGS. 4*a* and 4*b* operate using the same principle as the cartridge 70 described above with reference to FIG. 3 to heat first and second induction heatable elements 36*a*, 36*b* to different temperatures.

In more detail and referring initially to FIG. 4*a*, aerosol-forming liquid 34 is conveyed from the reservoir 32 to a first induction heatable element 36*a* by a plurality of capillary elements 38. The conveyed aerosol-forming liquid 34 is vaporised in use when it contacts the surface of the first induction heatable element 36*a* during operation of the aerosol generating system 10. The non-liquid flavour release medium 74 is adhered to the surface of a second induction heatable element 36*b*. As described above in connection with FIG. 3, during operation of the aerosol generating system 10 the second induction heatable element 36*b* is heated to a lower temperature than the first induction heatable element 36*a* and hence the non-liquid flavour-release medium 74 is heated to an optimum temperature to generate a suitable flavour and aroma without burning or charring the non-liquid flavour release medium 74. As a user inhales through the mouthpiece 44, it will be understood that the vapour generated by heating the aerosol-forming liquid 34 and the flavour compounds generated by heating the non-liquid flavour-release medium 74 combine to form an aerosol that has optimum flavour and aroma characteristics and in particular that mimics as closely as possible the flavour and aroma of a conventional lit-end cigarette.

The embodiment of FIG. 4*b* is similar to that of FIG. 4*a*, except that the non-liquid flavour-release medium 74 is packed around the second induction heatable element 36*b* instead of being adhered to its surface. In this embodiment, it will be noted that two air inlets 40 are provided in the housing 41 and that the air inlets 40 are positioned at a distal end of the housing 41 in order to optimise airflow through the non-liquid flavour-release medium 74.

It will be noted that the cartridges 72 illustrated in FIGS. 4*a* and 4*b* comprise a capillary element 76 to convey the aerosol-forming liquid 34 from the reservoir 32 to the non-liquid flavour-release medium 74. This ensures that the non-liquid flavour-release medium 74 does not completely dry out as it is heated, thereby reducing the likelihood of burning and/or charring and optimising the flavour and aroma released during the heating process.

Figure 5:
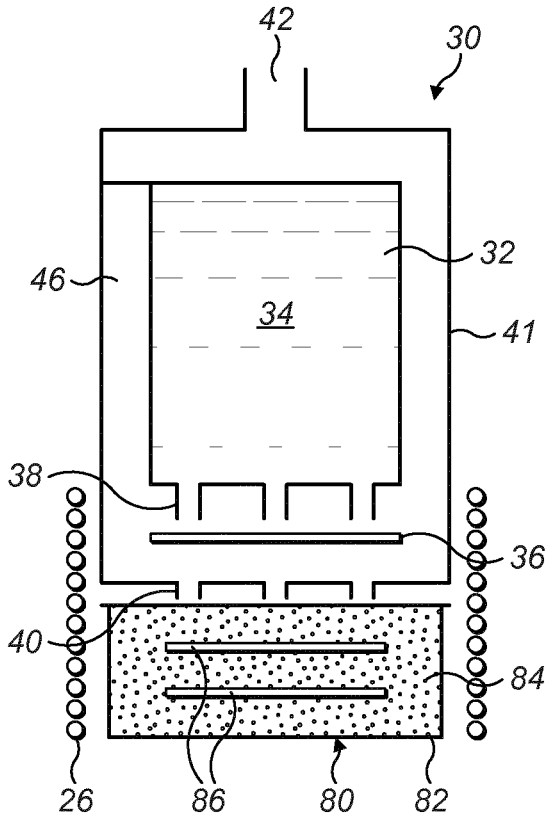
FIG. 5 is a diagrammatic cross-sectional view of a cartridge according to the present disclosure used in combination with a capsule containing a non-liquid flavour-release medium.

As an alternative to incorporating a non-liquid flavour-release medium into the cartridge 72 itself as shown in FIGS. 4*a* and 4*b*, any of the cartridges 30, 70 illustrated in FIGS. 2 and 3 can be used in conjunction with a capsule 80 as shown in FIG. 5 containing a non-liquid flavour-release medium 84. The capsule 80 is fully self-contained and is entirely separate from the cartridge 30. The capsule 80 comprises a shell 82 containing a non-liquid flavour-release medium 84 of the type already described. One or more induction heatable elements 86 are disposed inside the shell 82 and are arranged to heat the non-liquid flavour-release medium 84 during operation of the aerosol generating system 10. At least part of the shell 82 comprises an air permeable material so that air can flow through the shell 82. As a user inhales through the mouthpiece 44, it will be understood that the vapour generated by heating the aerosol-forming liquid 34 and the flavour compounds generated by heating the non-liquid flavour-release medium 84 combine to form an aerosol that has optimum flavour and aroma characteristics and in particular that mimics as closely as possible the flavour and aroma of a conventional lit-end cigarette. A suitable capsule 80 has been described in the Applicant's earlier patent application GB 2527597 A.

Figure 6:
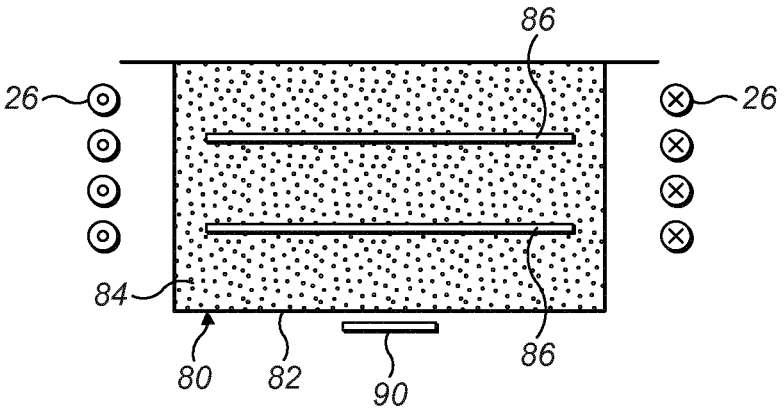
FIG. 6 is a diagrammatic view illustrating the use of a subsidiary induction heatable element for the purposes of temperature measurement.

FIG. 6 is an enlarged view of the capsule 80 shown in FIG. 5 and an associated induction coil 26 of an aerosol generating system 10. The aerosol generating system 10 employs a subsidiary induction heatable element 90 at least part of which is exposed or accessible to enable the temperature of the subsidiary induction heatable element 90 to be measured directly, for example using a temperature probe (not shown). A predetermined relationship between the temperature of the subsidiary induction heatable element 90 and the temperature of the induction heatable elements 86 inside the capsule 80 enables the temperature of the induction heatable elements 86 to be measured indirectly, by simply measuring the temperature of the subsidiary induction heatable element 90.

Although the use of a subsidiary induction heatable element 90 has been described only in connection with a capsule 80, it will be understood that the subsidiary induction heatable element 90 can be can be used in combination with any of the cartridges 30, 70 illustrated in FIGS. 1 to 4 to enable the temperature of the induction heatable elements 36 to be measured indirectly based on a predetermined relationship between the temperature of the subsidiary induction heatable element 90 and the temperature of the induction heatable elements 36.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments. Each feature disclosed in the specification, including the claims and drawings, may be replaced by alternative features serving the same, equivalent or similar purposes, unless expressly stated otherwise.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

Any combination of the above-described features in all possible variations thereof is encompassed by the present invention unless otherwise indicated herein or otherwise clearly contradicted by context.

The invention claimed is:

1. A cartridge for use with an aerosol generating system, the cartridge comprising:

a reservoir for storing an aerosol-forming liquid;

an induction heatable element comprising a substantially circular disc or a ring; and a capillary element for conveying the aerosol-forming liquid from the reservoir to the induction heatable element, the induction heatable element being arranged to heat the conveyed aerosol-forming liquid to vaporize it, wherein the capillary element is a capillary tube having a first end in contact with the aerosol-forming liquid in the reservoir and an opposite second end in contact with the induction heatable element, and wherein the second end includes a cut-out portion that defines an outlet configured to allow the conveyed aerosol-forming liquid to be transferred onto a surface of the induction heatable element with a surface level that corresponds to a depth of the cut-out portion.

2. The cartridge according to claim 1, wherein the cartridge includes a plurality of said capillary elements for conveying the aerosol-forming liquid from the reservoir to the induction heatable element.

3. The cartridge according to claim 1, wherein the cartridge further comprises:

a second reservoir for storing a second aerosol-forming liquid which differs in composition from the aerosol-forming liquid;

a second induction heatable element; and a second capillary element for conveying the second aerosol-forming liquid from the second reservoir to the second induction heatable element, the second induction heatable element being arranged to heat the conveyed second aerosol-forming liquid to vaporize it.

4. The cartridge according to claim 3, wherein the induction heatable elements are arranged to be heated to different temperatures by the aerosol generating system.

5. The cartridge according to claim 4, wherein the induction heatable elements are formed of different materials and/or have different dimensions.

6. The cartridge according to claim 1, wherein the cartridge further comprises a non-liquid flavor-release medium and a further induction heatable element arranged to heat the non-liquid flavor-release medium.

7. The cartridge according to claim 6, wherein the non-liquid flavor-release medium is adhered to a surface of the further induction heatable element.

8. The cartridge according to claim 6, wherein the non-liquid flavor-release medium is packed around the further induction heatable element.

9. A cartridge for use with an aerosol generating system, the cartridge comprising:

a reservoir for storing an aerosol-forming liquid;

an induction heatable element; and a capillary element for conveying the aerosol-forming liquid from the reservoir to the induction heatable element, the induction heatable element being arranged to heat the conveyed aerosol-forming liquid to vaporize it, wherein the cartridge further comprises a non-liquid flavor-release medium and a further induction heatable element arranged to heat the non-liquid flavor-release medium, and wherein the cartridge includes one or more further capillary elements for conveying the aerosol-forming liquid from the reservoir to the non-liquid flavor-release medium.

10. The cartridge according to claim 9, wherein the capillary element has a first end in contact with the aerosol-forming liquid in the reservoir and an opposite second end arranged to transfer the conveyed aerosol-forming liquid onto the induction heatable element.

11. The cartridge according to claim 10, wherein the second end of the capillary element contacts the induction heatable element and is shaped to define an outlet which enables the conveyed liquid to be transferred from the second end onto the induction heatable element.

12. The cartridge according to claim 10, wherein the second end of the capillary element is located adjacent to, but spaced apart from, the induction heatable element.

13. The cartridge according to claim 9, wherein the capillary element is selected from the group consisting of a capillary tube and a capillary wick.

14. The cartridge according to claim 9, wherein the capillary element contacts the induction heatable element.

15. The cartridge according to claim 9, wherein the capillary element is located adjacent to, but spaced apart from, the induction heatable element.

16. The cartridge according to claim 9, wherein the capillary element comprises a porous body.

17. The cartridge according to claim 16, wherein the porous body includes mineral wool.

18. The cartridge according to claim 16, wherein the porous body includes a porous ceramic material.

19. The cartridge according to claim 16, wherein the induction heatable element is encapsulated by the porous body.

20. The cartridge according to claim 9, wherein each of the one or more further capillary element is selected from the group consisting of a capillary tube and a capillary wick.

21. The cartridge according to claim 1, wherein the cartridge comprises a housing in which the reservoir is located, the housing having one or more air inlets through which ambient air can flow into the housing and a mouthpiece defining an outlet through which an aerosol can be inhaled by a user.

22. An aerosol generating system comprising:

a cartridge according to claim 1 and an induction heating arrangement arranged to inductively heat the induction heatable element.

23. The aerosol generating system according to claim 22, wherein the induction heating arrangement comprises an induction coil.

24. The aerosol generating system according to claim 22, wherein the aerosol generating system comprises a body in which the induction heating arrangement is accommodated and a cavity formed in the body in which the cartridge is removably inserted.

25. The aerosol generating system according to claim 22, further including a capsule comprising:

a shell containing a non-liquid flavour-release medium;

an induction heatable element disposed inside the shell and arranged to heat the non-liquid flavour-release medium;

at least part of the shell comprising an air permeable material.

26. The aerosol generating system according to claim 22, further including a subsidiary induction heatable element arranged to be heated by the induction heating arrangement;

wherein at least part of the subsidiary induction heatable element is accessible to enable the temperature of the subsidiary induction heatable element to be directly measured, and wherein a predetermined relationship between the temperature of the subsidiary induction heatable element and the temperature of the induction heatable element enables the temperature of the induction heatable element to be determined indirectly.

* * * * *